United States Patent [19]

Pereira

[11] 4,336,675

[45] Jun. 29, 1982

[54] CONSTRUCTION SYSTEM

[76] Inventor: Marcel Pereira, 1605 Croissant Donnacona, Duvernay, Laval, Quebec, Canada

[21] Appl. No.: 191,874

[22] Filed: Sep. 29, 1980

Related U.S. Application Data

[63] Continuation of Ser. No. 794,254, May 5, 1977, abandoned.

[51] Int. Cl.[3] ..... E04B 1/00

[52] U.S. Cl. ..... 52/267; 52/437

[58] Field of Search ..... 52/437, 438, 267, 605

[56] References Cited

U.S. PATENT DOCUMENTS

| | | | |
|---|---|---|---|
| 1,726,169 | 8/1929 | Winter | 52/435 X |
| 2,129,369 | 9/1938 | Faber | 52/438 X |
| 2,882,712 | 4/1959 | Carlson | 52/372 X |
| 2,994,162 | 8/1961 | Frantz | 52/437 X |
| 3,221,457 | 12/1965 | Vevoda | 52/438 |
| 3,759,002 | 9/1973 | Cornella et al. | 52/270 |
| 4,015,387 | 4/1977 | Tillie | 52/437 X |

*Primary Examiner*—Carl D. Friedman

*Attorney, Agent, or Firm*—Swabey, Mitchell, Houle, Marcoux & Sher

[57] ABSTRACT

A building construction includes load-supporting walls made up of precast modular members, each member being an elongated member having a web and channel-shaped ends such that when they are laid in vertical rows with adjacent rows abutting end to end, the channel members form closed vertical pillar chambers adapted to receive concrete poured in situ and cured to form pillars. Cladding is attached directly to the so-formed walls and floor members including elongated reinforced precast channels are laid side to side with concrete poured in situ about the channels and over them to form an integral floor.

3 Claims, 7 Drawing Figures

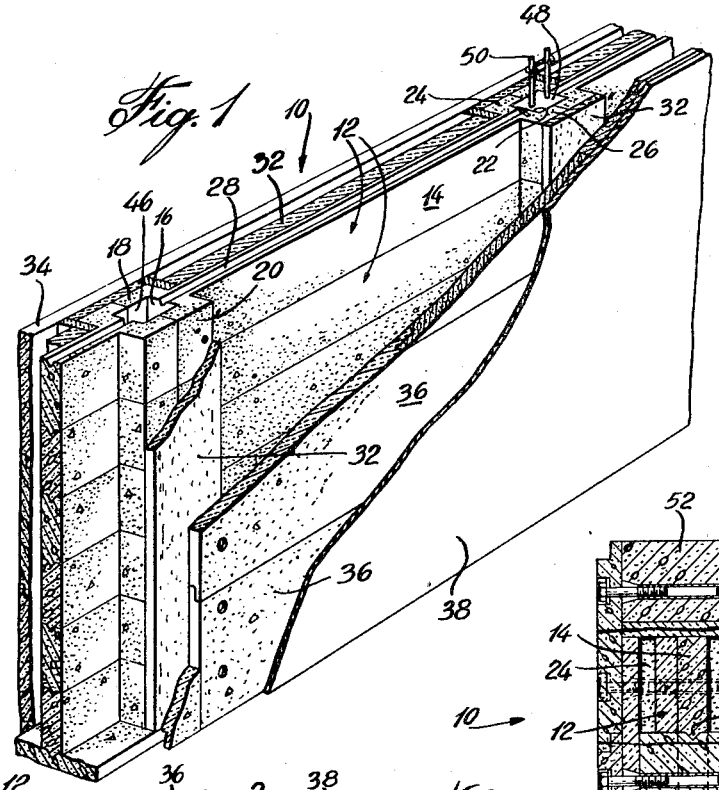
Fig. 1
10
12
14
16
18
20
22
24
26
28
32
34
36
38
46
48
50
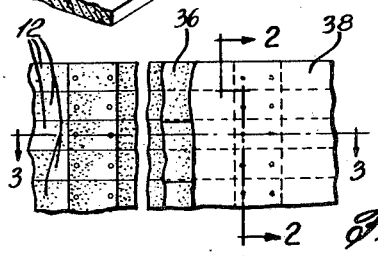
12
36
38
2
3
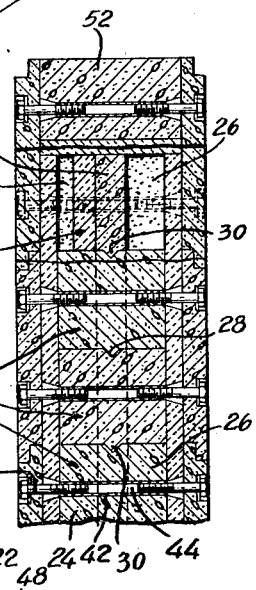
Fig. 2
10
12
14
24
26
28
30
40
42
44
52
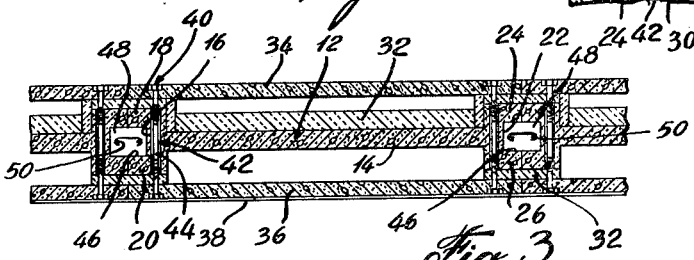
Fig. 1a
Fig. 3
12
14
16
18
20
22
24
26
32
34
36
38
40
42
44
46
48
50

CONSTRUCTION SYSTEM

This is a continuation, of application Ser. No. 794,254 filed May 5, 1977, abandoned.

BACKGROUND OF THE INVENTION

1. Field of the Invention

The present invention relates to a building construction, and especially to structural elements for buildings.

2. Description of the Prior Art

Presently in low and high-rise construction for commercial use, the floor is constructed by providing the necessary concrete forms and reinforcement grid, allowing the floor to cure, then building forms for pillars above the floor as well as providing the necessary reinforcing structure in these forms, pouring the concrete and allowing the pillars to cure. Only when the pillar forms have been cured can a subsequent superimposed floor be built. All of the weight of the subsequent floors is, therefore, carried by the pillars since the walls which are provided around the periphery of the floors are not load-bearing. These walls nevertheless are often in the form of precast concrete slabs which are so heavy as to need cranes to locate them in place along the periphery of the building. Such slabs, rather than contributing to the support structure of the building, merely add further weight to be carried by the structure. Furthermore, once these slabs or concrete blocks are in place, insulation material must be applied on the interior of the so-formed walls.

SUMMARY OF THE INVENTION

It is an aim of the present invention to provide a wall module of prefabricated construction which can be easily handled at the construction site and which can form part of a load-bearing wall. It is also an aim of the present invention to provide a building construction in which an improved floor construction is obtained in combination with the wall construction made up of modules.

A construction in accordance with the present invention includes a wall comprising a plurality of identical elongated horizontal preformed members, with each member having an open channel formed at each end thereof, the wall being made up of vertical rows of said members, with the ends of the members in adjacent rows abutting with corresponding members in other rows such that elongated vertical closed chambers are formed by the aligned channels, and load-supporting pillars formed in situ in the vertical chambers.

In a more specific embodiment, the walls have interior and exterior cladding attached to the elongated members and the height of each cladding member is approximately twice the height of each member.

It is also contemplated that a plurality of floor members be supported on and between spaced-apart such walls, each floor member including an elongated preformed U-shaped channel closed at the ends, the legs of each channel having flanges formed outwardly. Each member is laid flange to flange such that an upwardly opened valley is provided between each member and concrete is formed in situ between the floor members.

BRIEF DESCRIPTION OF THE DRAWINGS

Having thus generally described the nature of the invention, reference will now be made to the accompanying drawings, showing by way of illustration, a preferred embodiment thereof, and in which:

FIG. 1 is a perspective view, partly in section, of a wall construction made in accordance with the present invention;

FIG. 1*a* is a fragmentary front elevation of the wall in FIG. 1;

FIG. 2 is a fragmentary, vertical cross-section taken along line 2—2 of FIG. 1*a;*

FIG. 3 is a horizontal sectional view taken along line 3—3 of FIG. 1*a;*

DESCRIPTION OF THE PREFERRED EMBODIMENTS

Figure 4:
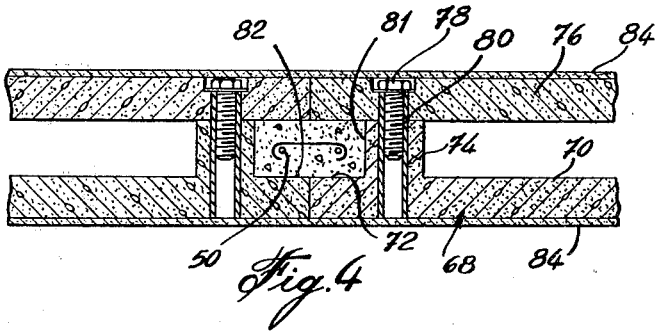
FIG. 4 is an enlarged fragmentary, horizontal cross-section of a detail of another embodiment of the present invention.
Figure 5:
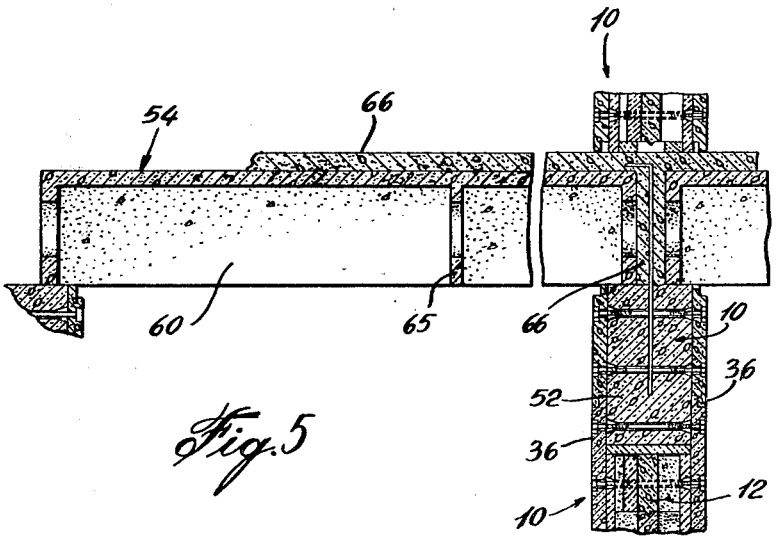
FIG. 5 is a vertical cross-section taken through a typical floor member and wall construction.

Referring now to the drawings, and particularly to FIG. 1, there is shown a wall construction 10 made up of a plurality of wall members 12. Each wall member 12 has a web 14 and at opposite ends of the web, an end channel 16 made up of legs 18 and 20, and an end channel 22 made up of legs 24 and 26. The web contains a groove 28 on one edge thereof and a rib 30 on the other edge such that when the modular members 12 are stacked one above the other, the rib 30 will fit in the groove 28 as shown in FIG. 2. The members 12 which are identical and which form the modular element of the wall construction, are normally precast and formed in a factory with the necessary reinforcing grids provided in the mold.

Each member is designed to be portable by at least two men and is approximately 6 inches in height with the length varying from 2.5 feet to approximately 12 feet.

In construction, the modular elements 12 are laid one on top of each other without the need for mortar, such that the channels 16 and 24 respectively are aligned with the bottom member 12. Subsequent rows of members 12 are also laid with the ends thereof abutting against the ends of adjacent rows so as to form closed pillar-forming chambers 46 between the channels 16 and 22 of the ends of the members 12. Once the desired wall height has been attained, concrete can be poured in situ in the so-formed chambers 46 after suitable reinforcing steel 50 has been placed. The pillar chambers 46 provide a mold for the pillar 48 while it is being cured.

Above the rows of wall members 12, a crown 52 can be poured using suitable concrete forms such that a continuous band or crown 52; see FIG. 2 of reinforced concrete is provided above the wall 10 and is connected with the pillars 48.

The interior and exterior of the wall 10 is provided with preformed concrete cladding 34 and 36. Each cladding member is an individual elongated panel having a height approximately twice the height of the individual wall modular members. The legs 16 and 20, for instance, of the channel end 18 of a member include preformed bores 44 in which are provided anchor sleeves 42 for retaining the bolts 40, thereby anchoring the cladding 34 and 36 to the so-formed wall 10.

Insulation panels 32 of various molded types, such as panels of foamed polystyrene, can be adhered to the so-formed wall, as shown in the drawings. The cladding would normally sandwich panels of insulation 32 against the legs of the channels 16 or 22.

A suitable finishing panel 38, such as plaster board, can be adhered to the interior cladding 36 to provide the finished wall.

The panels 34 or 36 can be removed and replaced independently if necessary. Plumbing and electrical conduits can be located between the panels 36 and the members 12.

If it is required to have interior partitioning walls of suitable construction on the interior of the building, an embodiment such as shown in FIG. 4 can be used. The modules of this embodiment are lighter than the modules of the exterior supporting walls 10 with the partition wall 68 being made up of modular members 70 having a leg 72 and a flange 74 along with a second member 76 attached to the first member 68 by means of a bolt 78 anchored in the sleeve 80. A channel 81 is formed. The height and length dimensions of the modular members 70 and 76 are similar to those of members 12. Again, rows of members 70 and 76 are abutted end to end forming pillar chambers 82 and reinforced pillars can be provided in a similar manner to that described with the walls 10. Finally, acoustical insulation can be provided within the chambers formed between the members 68 and 76, and certainly finishing panels 84 can be adhered to the outside of the so-formed concrete modular wall.

Figure 6:
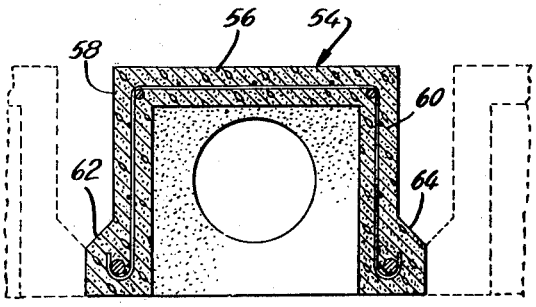
FIG. 6 is an enlarged vertical cross-section taken laterally of a typical floor member showing adjacent floor members in dotted lines.

The floors are made up of elongated box-like channel members 54, each supported at its end on supporting walls 10 or similar partition walls 68. The floor members 54, as mentioned, are precast and are elongated channel members closed at each end and each has a web 56 including legs 58 and 60 with flanges 62 and 64 respectively. The floor member 54 also includes spaced-apart structural partition members 65 to structurally enhance the floor member 54. The members 54 are laid side to side, as shown in FIG. 6, with the flanges 62 and 64 abutting adjacent flanges of adjacent floor members. Then, concrete can be poured in situ filling the valleys formed between the members and contained by the flanges 62 and 64. A thin web of concrete 66 can also be poured above the floors integral with the concrete poured between the members forming an integral strong floor member.

The plumbing and electrical conduits can be located between the floor members 54 before the concrete 66 is poured. Alternatively, the conduits for plumbing and electricity can be located inside the member 54 passing through apertures provided in the partitions 65.

I claim:

1. For use in a building structure including a supporting floor, and a load-bearing wall construction comprising:

a plurality of manually-portable, preformed wall members comprising a relatively thin web integral, at opposite ends, with a symmetrically-disposed, transverse wall from which project spaced legs parallel to the web forming both vertically and outwardly opening channels, said legs, wall and webs extending vertically and being co-extensive in height, each wall member comprising a manually-portable module permitting the wall to be manually erected by workmen, the modules having a height-to-length ratio between 1:5 and 1:25, the wall comprising modules lying on edge one-on-top-of-the-other, with the vertically opening channels being in vertical alignment, and vertically-open channels of next adjacent modules being in abutment with and opening into open channels of next adjacent modules and forming therewith vertically extending chambers extending the height of the wall structure, interior and exterior cladding juxtaposed on and secured to outer and inner surfaces of the module legs and forming on opposite sides of the webs spaces for receiving insulation and utilities, portions of said cladding projecting vertically beyond the vertically-extending chambers at said channels, said exterior cladding being of a height greater than the height of said modules and overlapping adjacent horizontal margins of said modules forming the wall construction for stabilizing the same; and concrete poured into said vertically extending chambers and between said cladding beyond said vertically extending chambers and forming an integrating concrete connection in the vertically extending chambers and thereabove to provide a crown for a floor and to integrate the modules at the load-bearing wall.

2. The structure as claimed in claim 1 in which each module includes on its lower and upper edge an integral, respective male and female aligning means comprising a groove and rib within the width of said web for facilitating manual orientation and erection of said modules prior to pouring and concrete to integrate the modules and cladding.

3. The structure as claimed in claim 1 in which said exterior cladding is rectangular and has a length co-extensive with the length of the modules, the height of said exterior cladding being approximately twice the height of the individual modules.

* * * * *